US006366251B1

(12) United States Patent
Pokryvailo et al.

(10) Patent No.: US 6,366,251 B1
(45) Date of Patent: Apr. 2, 2002

(54) ANTENNA PROTECTION DEVICE

(75) Inventors: Alex Pokryvailo, Ashdod; David Melnik, Rehovot; Joseph Ashkenazy, Rehovot; Shlomo Wald, Rehovot; Eliahu Sayag, Holon; Moshe Katz, Rishon le Zion, all of (IL)

(73) Assignee: The State of Israel, Atomic Energy Commission, Soreq Nuclear Research Center, Yavne (IL)

( * ) Notice: Subject to any disclaimer, the term of this patent is extended or adjusted under 35 U.S.C. 154(b) by 0 days.

(21) Appl. No.: 09/549,352

(22) Filed: Apr. 14, 2000

(30) Foreign Application Priority Data

May 13, 1999 (IL) ..... 129934

(51) Int. Cl.[7] ..... H01Q 1/52
(52) U.S. Cl. ..... 343/722; 343/900
(58) Field of Search ..... 343/720, 722, 343/749, 900, 901; 361/1, 56, 117–119; H01Q 1/52, 1/00

(56) References Cited

U.S. PATENT DOCUMENTS

| | | | | |
|---|---|---|---|---|
| 3,176,298 A | * | 3/1965 | Nettles | 343/722 |
| 4,092,646 A | * | 5/1978 | Newington | 343/749 |
| 4,513,338 A | | 4/1985 | Goodall et al. | 361/1 |

* cited by examiner

*Primary Examiner*—Michael C. Wimer
(74) *Attorney, Agent, or Firm*—Fitch, Even, Tabin & Flannery

(57) ABSTRACT

An antenna protection device for insertion between sections of an antenna for cutting the passage of low-frequency alternating electric current. The device comprises a non-linear capacitor with capacitor plates connected to the antenna sections. The non-linear capacitor is characterized by a negative low-frequency voltage coefficient, whereby the passage of a high frequency alternating current remains essentially unaffected.

10 Claims, 2 Drawing Sheets

ANTENNA PROTECTION DEVICE

FIELD OF THE INVENTION

This invention is in the field of antennas and more specifically relates to antennas of portable radio equipment. The invention further relates to portable electronic equipment such as a radio transmitter/receiver, fitted with said antennas.

BACKGROUND OF THE INVENTION

Antennas of portable radio-frequency (RF) equipment may in use inadvertently impinge upon an external high voltage source such as an overhead power line. In the absence of any means of protection, contact of the antenna with the voltage source poses a serious hazard to the RF equipment and its carrier. If the carrier is a vehicle, it may be seriously damaged by the resulting high voltage electric current passing through it. For a human carrier, the electric current may be fatal. Antennas of portable RF equipment are therefore commonly provided with means to protect the carrier from electric shock. In the case of a human carrier, the electric current must be lowered to below the so called let-go level which is about 10 mA for males and 7 mA for females.

One method of protection is provided by coating the antenna with an insulating compound. This, however, adds considerable weight to the antenna and does not provide reliable protection as the coating eventually becomes scratched and attenuated due to abrasion of the antenna with external objects.

Antenna protection is also provided by a series-opening switch. However, the long opening time of the switch, exceeding several milliseconds, compromises the protection afforded. Opening switches are also very bulky and are thus not suitable for foot-carried RF equipment. Another method of antenna protection is bypassing high voltage shocks to ground using closing switches. This method however is not applicable to foot carried RF equipment. Moreover, closing and opening switches are activated by a sensor that inevitably introduces a dangerous delay in their operation and may, conversely, also produce false alarms.

Another method of antenna protection involves inserting a high-pass filter into the antenna between the RF equipment and carrier on the one hand and the distal section of the antenna likely to contact an overhead power line on the other, as disclosed, for example in U.S. Pat. No. 4,513,338. This patent discloses an antenna protection device comprising a linear capacitor having a Teflon™ dielectric to suppress the low-frequency current component while causing minimal signal loss at the higher operating frequencies. In practice, however, with a linear filter such as this, the low frequency component cannot be filtered out below the let-go level without an unacceptable loss in the intensity of the high frequency signal.

SUMMARY OF THE INVENTION

The present invention provides a device for use with portable RF equipment coupled to an antenna for protecting the equipment and its carrier from electric shocks resulting from antenna contact with an external power source such as overhead power lines. The invention is designed to be incorporated into an antenna and is easily retrofitted into existing antennas. The invention causes minimal signal loss even at relatively low signal frequencies of several MHz while suppressing the line frequencies of 50–60 Hz to below the let-go level.

The device of the invention comprises one or more non-linear high voltage capacitors. Capacitors having these characteristics are known in the art and may be purchased for example from Thomson-CSF, Vishay, Ceramite, or Morgan-Matroc. These capacitors have ceramic dielectrics generally known in the art as Class II, or Type II ceramics that are generally strontium-based and have a negative DC voltage coefficient. In accordance with the invention it was found that at line frequencies these capacitors also have a negative AC voltage coefficient. This non-linearity may reach 90–95%, in which case at line frequency the capacitor possess 10–20 fold greater impedance compared to a linear capacitor with the same nominal capacitance. Such a capacitor will reduce a 50–60 Hz line current component 10–20 fold with minimal effect on a signal component of over 15 MHz.

The present invention thus provides a device for insertion between first and second antenna sections and capable of significantly cutting the passage of an alternating electric current having a frequency lower than a first desired predetermined value, characterized in that it comprises a non-linear capacitor with first and second capacitor plates linked to first and second terminal means and serving for the connection of said first and second antenna sections, which non-linear capacitor is characterized by a negative low-frequency voltage coefficient, whereby the passage of an alternating electric current of a frequency higher than a second desired predetermined value remains essentially unaffected.

The invention further provides an antenna assembly having at least two antenna sections connected to the first and second terminals of a protection device of the kink specified.

Still further, the invention provides radio equipment fitted with such an antenna assembly.

BRIEF DESCRIPTION OF THE DRAWINGS

For better understanding, some preferred embodiments of the invention will now be described, by way of non-limiting examples only, with reference to the accompanying drawings, in which.

DETAILED DESCRIPTION OF A PREFERRED EMBODIMENT

Figure 1:
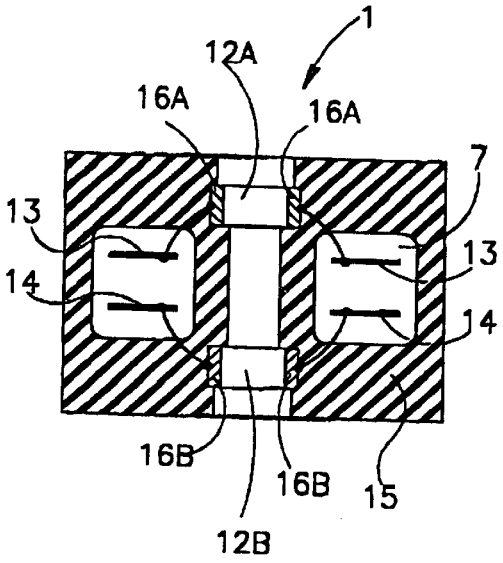
FIG. 1 shows an embodiment of an antenna protection device according to the invention with a coaxial capacitor.

Reference is first made to FIG. 1 which shows a cross section of an antenna protection device, generally indicated by 1, in accordance with one embodiment of the invention. Capacitor 7 is a non-linear capacitor with a high negative voltage coefficient as described above and has annular plates 13 and 14 connected to metal terminals 16*a* and 16*b* respectively. Capacitor 7 is encapsulated within solid case 15, which may be, for example, an epoxy compound or other suitable insulation material. Bushings 12*a* and 12*b* are each designed to receive an end of a section of an antenna (See FIG. 2).

Figure 2:
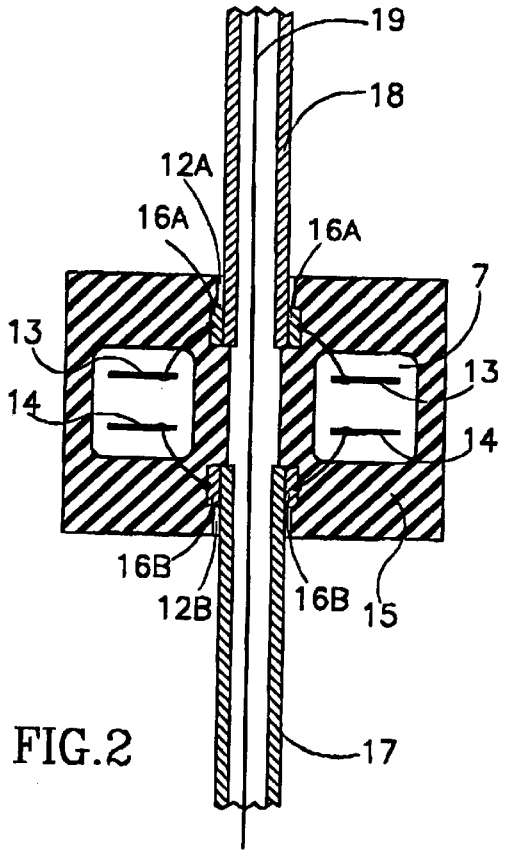
FIG. 2 shows an antenna comprising the protection device of FIG. 1.

FIG. 2 shows an antenna comprising the protection device shown in FIG. 1. The proximal end of proximal section 17 is connected to the RF equipment (not shown). The distal end of proximal section 17 of the antenna is inserted into bushing 12*b* and contacts terminals 16*b*. The proximal end of distal section 18 is inserted into bushing 12*a* and contacts terminals 16*a*. The length of proximal section 17 is preferably about 1–2.5 m. With this arrangement, the section of the antenna most likely to contact an overhead power line is contained within its distal section 18, while distal section 18 is unlikely to be inadvertently touched by a human carrier. The distal and proximal sections of the antenna are tied together by an insulating elastic cord 19 passing through the hollow interior 20 of the antenna.

Figure 3:
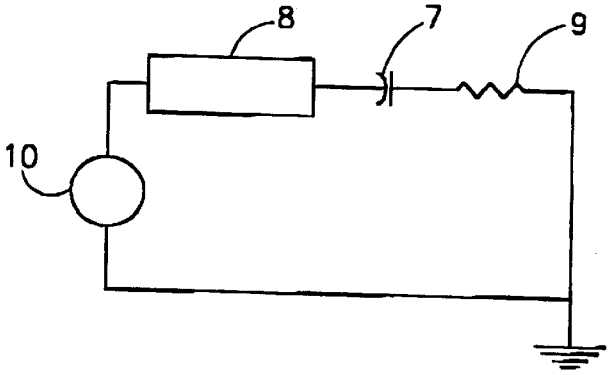
FIG. 3 is an equivalent electric circuit of a foot carried RF device comprising an antenna protection device.

FIG. 3 is an equivalent electrical circuit of an antenna attached to a radio receiver/transmitter carried by a human carrier when the antenna comprises a protection device comprising a capacitor 7 and the antenna is in contact with an overhead power line. The impedance 8 of the antenna sections is negligible at the line frequency and the human body possesses relatively low impedance up to several kOhm. Assuming a typical voltage 10 in the overhead power line of 19 kV, when capacitor 7 is selected in accordance with the invention, for example a 1 nF capacitor having a −70% capacitance reduction at this line voltage, the current 9 passing through the human carrier would be about 3.6 mA, which is below the let go current. At the same time, this capacitor would cause only a 7–10% decrease in the intensity of a 15 MHz radio signal. In contrast to this, if capacitor 7 is the linear 1 nF capacitor disclosed in U.S. Pat. No. 4,513,338 having a Teflon™ dielectric, the current 9 passing through the human carrier would be about 12 mA, which is not below the let go current.

Figure 4:
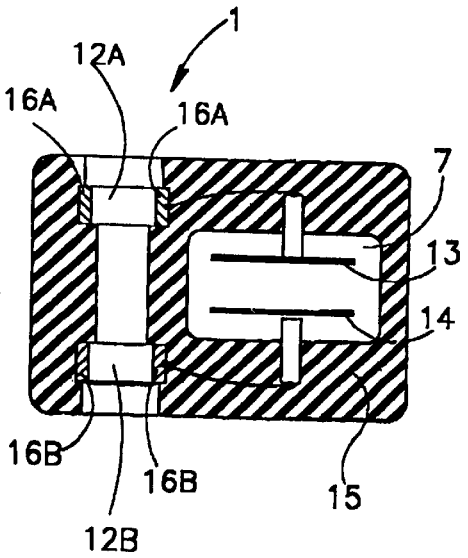
FIG. 4 shows an embodiment of an antenna protection device according to the invention with an off-axis capacitor.
Figure 5:
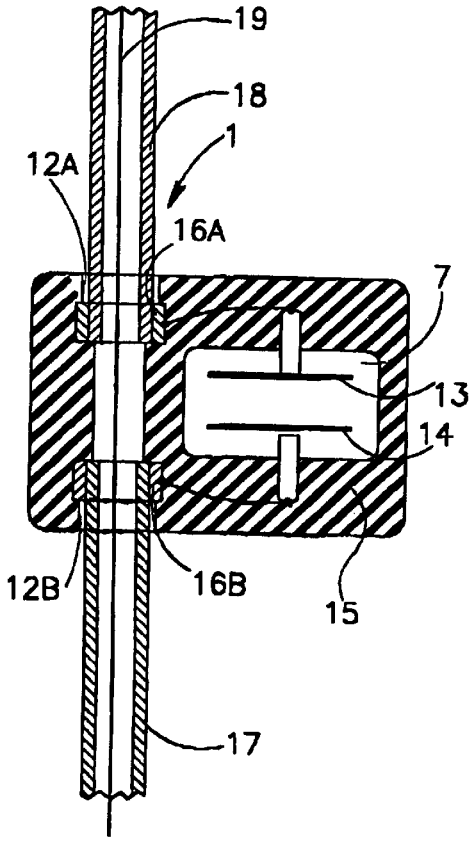
FIG. 5 shows an antenna assembly according to the invention comprising the protection device of FIG. 4.

FIG. 4 shows a cross section of another embodiment of the antenna protection device in accordance with the invention. This antenna protection device is generally similar to the device shown in FIG. 1, and the same numbering has been used to identify the same components. In FIG. 4, capacitor 7 is encased off-axis in such a way that when sections of an antenna are inserted in to bushings 12*a* and 12*b*, the antenna bypasses capacitor 7. FIG. 5 shows an antenna assembly according to the invention, comprising the protection device shown in FIG. 4 with the antenna sections 17 and 18 inserted into the bushings 12*a* and 12*b* similar to that described with reference to FIG. 2.

Figure 6:
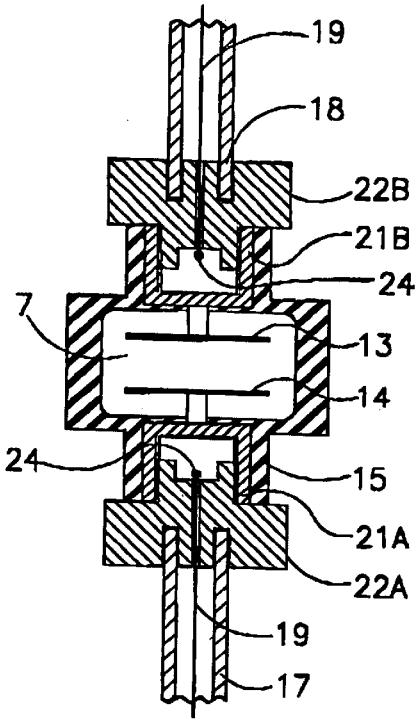
FIG. 6 shows another embodiment of an antenna protection device according to the invention with coaxial capacitor, comprising terminal bearing threaded inserts.

FIG. 6 shows an antenna assembly comprising yet another embodiment of the antenna protection device of the invention. This antenna is generally similar in the antenna shown in FIG. 2, and the same numbering has been used to identify the same components. Capacitor 7 is encased by solid insulator 15 provided with high voltage bushings formed by screw threaded metal plugs 21*a* and 21*b* connected to capacitor plates 13 and 14 respectively. This protects capacitor 7 from exposure to rain or moisture that might adversely affect the dielectric strength of capacitor 7. Antenna sections 17 and 18 are inserted into threaded adapters 22*a* and 22*b*, respectively, that are screwed into the sockets formed by plugs 21*a* and 21*b*.

Figure 7:
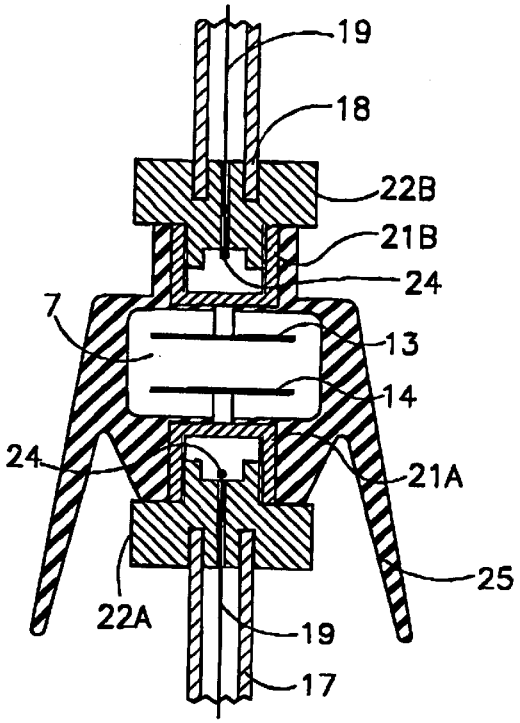
FIG. 7 shows an assembly according to the invention similar to that of FIG. 6 and comprising a concentric skirt in accordance with another embodiment of the invention.

FIG. 7 shows yet another embodiment of an antenna assembly comprising an antenna protection device in accordance with the invention. This antenna is generally similar to the antenna shown in FIG. 6, and the same numbering has been used to identify the same components. Solid casing 15 is furnished with a concentric skirt 25 for protection against adverse environmental effects.

The antenna assembly comprising an antenna protection device in accordance with the invention, for example, as shown in FIGS. 2, 5, 6 and 7, may be attached to a radio transmitter/receiver by means known in the art.

It will be apparent to those skilled in the art that modifications may be made without departing from the spirit and scope of the invention. Accordingly, it is not intended that the invention be limited except as may be necessary in view of the appended claims.

What is claimed is:

1. An antenna protection device for insertion between first and second antenna sections for reducing the passage of an alternating electric current having a frequency lower than a first predetermined value, the protection device comprising a non-linear capacitor having a nominal capacitance connected in series between said first and second antenna sections, and the non-linear capacitor exhibits a negative low-frequency voltage coefficient, such that the passage of an alternating electric current of a frequency higher than a second desired predetermined value remains essentially unaffected and the passage of electric current of a frequency less than the first predetermined value is impeded by a capacitance less than the nominal capacitance.

2. The antenna protection device according to claim 1, comprising first and second capacitor plates having an annular configuration with the annular axis coextensive with the longitudinal axis of the first and second antenna sections.

3. The antenna protection device according to claim 1, wherein the capacitor is not in alignment with the longitudinal axis of the first and second antenna sections.

4. The antenna protection device according to claim 1, comprising a first and second terminal for connecting the non-linear capacitor in series to the first and second antenna sections, wherein each of said first and second terminals has corresponding, respective first and second high voltage bushing formed by a screw threaded metal plug for inserting the corresponding, respective one of the first and second antenna sections therein.

5. The antenna protection device according to claim 1, further comprising means for protection from adverse environmental effects.

6. The device according to claim 1, wherein the first predetermined frequency value is approximately 60 Hz and the second predetermined frequency value is approximately 15 MHz.

7. The device according to claim 6, wherein the amperage through the capacitor of an electric current having a frequency of under 60 Hz is reduced to below approximately 7 mZ and the amperage through the capacitor of an electric current having a frequency of over 5 MHz substantially unaffected.

8. An antenna assembly having at least two antenna sections connected to the protection device of the kind defined in claim 1.

9. The antenna protection device according to claim 5, wherein the device is coupled with radio equipment.

10. The antenna protection device according to claim 1, wherein the capacitor is non-linear with respect to voltage.

* * * * *